United States Patent [19]

Guerret

[11] Patent Number: 5,020,551

[45] Date of Patent: Jun. 4, 1991

[54] METHOD FOR MANUFACTURING A MAKE-UP BRUSH

[75] Inventor: Jean-Louis Guerret, Paris, France

[73] Assignee: L'Oreal, Paris, France

[21] Appl. No.: 417,719

[22] Filed: Oct. 5, 1989

[30] Foreign Application Priority Data

Oct. 12, 1988 [FR] France ..... 88 13409

[51] Int. Cl.[5] ..... A45D 24/00

[52] U.S. Cl. ..... 132/200; 132/218; 132/320; 401/126; 401/129; 300/21; 15/159 A

[58] Field of Search ..... 132/200, 216, 218, 320, 132/901; 401/126, 129; 15/159 A, 159 R; 300/21

[56] References Cited

U.S. PATENT DOCUMENTS

| | | | |
|---|---|---|---|
| 3,186,018 | 6/1965 | Shaw | 15/159 A |
| 3,238,553 | 3/1966 | Bailey et al. | 15/159 A |
| 3,295,156 | 1/1967 | Brent | 15/159 A |
| 3,325,845 | 6/1967 | Sawkiw . | |
| 3,344,457 | 10/1967 | Grobert | 15/159 R |
| 3,471,202 | 10/1969 | Lewis, Jr. | 300/21 |
| 3,616,480 | 11/1971 | Feroce et al. | 15/159 A |
| 3,881,211 | 5/1975 | Rhodes | 15/159 A |
| 4,461,312 | 7/1984 | Gueret | 132/218 |
| 4,632,136 | 12/1986 | Kingsford | 132/218 |
| 4,733,425 | 3/1988 | Hertel et al. | 132/218 |
| 4,756,044 | 7/1988 | Clark | 15/159 A |

FOREIGN PATENT DOCUMENTS

| | | | |
|---|---|---|---|
| 0250680 | 1/1988 | European Pat. Off. . | |
| 2757046 | 7/1979 | Fed. Rep. of Germany | 15/159 A |
| 2505633 | 11/1982 | France . | |
| 1319399 | 6/1973 | United Kingdom | 132/218 |
| 2170996 | 8/1986 | United Kingdom | 132/218 |

*Primary Examiner*—John J. Wilson
*Assistant Examiner*—Frank A. LaViola
*Attorney, Agent, or Firm*—Cushman, Darby & Cushman

[57] ABSTRACT

The brush (1) comprises a multiplicity of bristles (2) mounted on a core (3) and oriented transversely relative to this core. At least some of the ends (5) of the bristles (2) of the brush, furthest from the core (3), are shredded and have small hooks (6). These shredded ends (5) may be obtained by rotary grinding using a grinding wheel (8).

7 Claims, 2 Drawing Sheets

METHOD FOR MANUFACTURING A MAKE-UP BRUSH

FIELD OF THE INVENTION

The invention relates to a brush for applying a make-up Product, in particular for applying mascara to the eyelashes or a dye to the hair, of the type comprising a multiplicity of bristles mounted on a core and oriented transversely relative to the median direction of this core.

In general, the core of the brush is formed by two branches of a metal wire twisted into a helix, the bristles being gripped in the turns formed by these twisted branches

BACKGROUND OF THE INVENTION

In order to ensure satisfactory making up of the eyelashes using such a brush, it is necessary not only for the eyelashes to come into contact with the make-up product on the bristles of the brush, but also for the eyelashes to be touched by the ends of the bristles so as to smooth the product along the eyelashes.

To this end, it has already been proposed, in the case of brushes equipped with synthetic bristles, to form balls at the ends of the bristles by singeing these ends. However most of the time the ends become too thick, stiffen the brush, and damage the wipers provided in the product reservoirs. Moreover, the rounded ends thus obtained do not ensure a satisfactory smoothing of the eyelashes.

The principal aim of the invention is to provide a brush of the type defined above which meets, better than hitherto, the various practical requirements and which, in particular, makes it possible to improve making up by satisfactorily smoothing the eyelashes or the hair.

SUMMARY OF THE INVENTION

According to the invention there is provided a brush for applying a make-up product, comprising a multiplicity of bristles mounted on a core and oriented transversely relative to the median direction of said core, wherein at least some of said bristles have at their ends farthest from the core small shredded hooks The eyelashes or the hair on which a make-up product has to be spread can thus be touched effectively by these shredded ends.

The brush preferably comprises bristles with a relatively large diameter, generally between 10 hundredths of a millimetre (0.10 mm) and 30 hundredths of a millimetre (0.30 mm), the shredded ends being formed essentially by the ends of these large diameter bristles.

The sections of the bristles, particularly of the large diameter bristles, preferably have a form belonging to the group of following forms: solid circular form; hollow circular form; cruciform; and multilobed form, particularly three-lobed, or horseshoe form; each of these sections giving a different distribution of hooks at the shredded end.

The radial dimension of the bristles may vary along the axial direction of the brush such that the longitudinal profile of the brush can vary according to the desired uses.

The brush may comprise mixed bristles having hardnesses which are different when dry but the same when the bristles are moistened by the product; for example, it is possible to provide a mixture of cylindrical bristles with a solid cross-section having a diameter of 24 tens of a millimetre (0.24 mm) in nylon 6, of bristles with a horseshoe cross-section in nylon 11 having a diameter of 17 hundredths of a millimetre (0.17 mm), and of bristles of cruciform cross-section in nylon 6.6 having a diameter of 17 hundredths of a millimetre (0.17 mm).

The bristles of the brush may be of animal origin or synthetic origin, for example made from nylon or polyester. The bristles of natural origin may be used in a mixture with synthetic fibres.

The invention also relates to a method for manufacturing a make-up product applying brush as defined above, wherein a multiplicity of bristles are mounted on a core and oriented transversely relative to the median direction of the core, and the ends of the bristles of the brush then undergo a rotary grinding in order to shred the ends of the bristles farthest from the core and to form small hooks at said ends.

The brush is preferably at least partially equipped with bristles of a relatively large diameter, in particular between 0.1 mm and 0.3 mm, the shredding produced by the grinding essentially affecting these bristles of relatively large diameter.

It is possible to produce the brush with a mixture of bristles of relatively large diameter, greater than 0.1 mm, and of bristles of a diameter less than 0.1 mm, in particular of the order of 0.06 mm; practically without modifications, the bristles of small diameter undergo grinding such that after grinding the brush comprises bristles of large diameter with shredded ends and bristles of smaller diameter whose ends are not shredded.

It is possible to rotate the brush in one direction about the axis of its core whilst rotating the grinding wheel in the opposite direction about an axis of rotation which is substantially parallel to that of the brush so as to obtain a meshing effect between the grinding wheel and the bristles of the brush, the speeds of rotation of the brush and of the grinding wheel being adjusted to different values in order to obtain a gradual grinding without heating up.

It is also possible to grind the brush by rotating the grinding wheel about an axis which is substantially orthogonal to that of the core, it being possible for the brush to remain stationary.

It is possible to use shaped grinding wheels so as to give the brush the desired profile in the longitudinal direction.

It is also possible to grind into shape a brush which has already been cut with clippers.

The grinding parameters, in particular the dimension of the grains of the grinding wheel used, the grinding time and pressure, are chosen so as to obtain the type of hook which is desired at the end of the bristles.

Apart from the arrangements set forth above, the invention consists in a number of other arrangements which will be dealt with in more detail hereinafter by way of illustrative, but in no way limiting, embodiments described with reference to the appended drawings, in which:

DETAILED DESCRIPTION OF THE INVENTION

Figure 1:
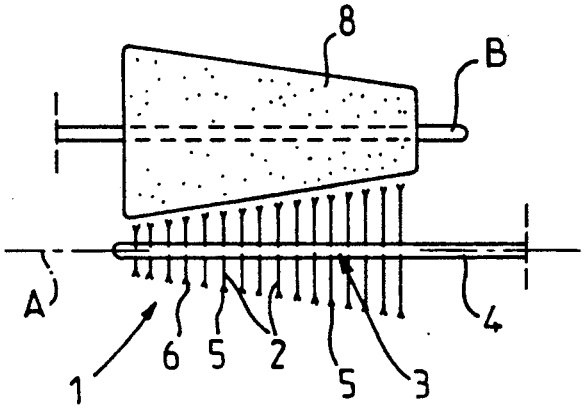
FIG. 1 is a simplified diagram of the grinding stage of a brush according to the invention.
Figure 2:
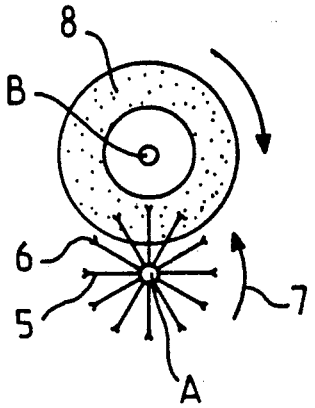
FIG. 2 is a view from the right relative to FIG. 1.
Figure 3:
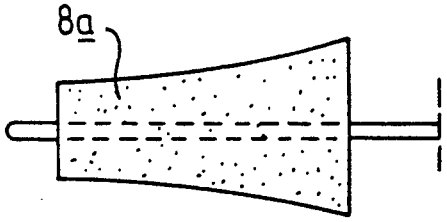
FIG. 3 is a diagrammatic view, in elevation, of a shaped grinding wheel with a generatrix in the form of an arc of a curve which is concave towards the outside.

With reference to FIGS. 1 and 2, these show the manufacture of a brush 1 for applying mascara to the eyelashes. This brush comprises a multiplicity of bristles 2 mounted on a core 3 and oriented transversely relative to the median direction, or axis, of this substantially rectilinear core. The core 3 is generally formed from two branches of a metal wire twisted into a helix the bristles 2 being gripped between these twisted branches.

After mounting the bristles on the core, the brush I is generally then shaped. In the example of FIG. 1, the brush 1 has been given a frustoconical shape, the small end of which is farthest from the part 4 of the core which acts as a handle and which has no bristles.

During manufacture, when the bristles 2 which are substantially all of the same length have just been mounted on the core 3, the brush 1 has a substantially cylindrical form. conventionally, shaping of the brush may be performed by a clipper (not shown), while the rod or core 3 of this brush is mounted on a lathe. The ends of the bristles 2 are cut very cleanly by being held between a clamp and a rotating blade of the clipper.

This very clean cutting performed by the clipper gives the bristles flat ends. It has been observed that such ends do not enable the eyelashes to be touched satisfactorily.

Moreover, it is desired to use bristles, advantageously equipped with capillary grooves, of relatively large diameter in particular of the order of 0.2 to 0.25 mm, Which are non-cylindrical and form a reservoir; the use of such bristles of relatively large diameter makes it possible to reduce their number (that is to say, to "debristle" the brushes) by increasing the spacing between the bristles which has the result of enabling the eyelashes to seek the product and to be coated further. Up to the present time, a brush for mascara, equipped with such bristles of relatively large diameter and which has not yet been moistened with the product, is very hard and becomes damaging particularly because of the very clean cut of the ends of the bristles produced by the conventional clippers. This constitutes a drawback which limits the use of the bristles of large diameter.

In order to remedy the disadvantages mentioned above, the brush 1 is manufactured with bristles, at least some of which comprise shredded ends 5 and have small hooks 6. These ends 5 are radially furthest from the core 3.

The radial dimension (or length) of the bristles 2 may be variable along the axial direction of the brush 1 so that the longitudinal profile of the brush can vary according to the desired uses.

In order to create the shredded ends 5, after mounting of the bristles 2 on the core 3, the brush I preferably undergoes a rotary grinding intended to act on the bristle ends.

In the illustrative embodiment in FIG. 1, the brush 1 is rotated about the axis A of the core 3 in a specific direction, for example the anticlockwise direction as represented by the arrow 7 in FIG. 2. A grinding wheel 8 is caused to act on the ends of the bristles 2 while rotating about an axis B, parallel to the axis A in the direction opposite to that of the brush 1 that is to say in the clockwise direction in the example under consideration. A meshing effect is thereby obtained which makes it possible to grind the brush 1 while adjusting the speed of rotation of the brush and of the grinding wheel to different values. Gradual grinding is thereby obtained, without heating up, thus finely shredding the ends 5 of the bristles and making it possible to obtain a multiplicity of small hooks 6 capable of touching the eyelashes.

In the example in FIG. 1, the grinding wheel 8 has a frustoconical form similar to that of the brush 1 but rotated through 180°.

The grinding parameters, such as the dimension of the grains of the grinding wheel 8 used, the grinding time and grinding pressure, are chosen as a function of the type of hooks 6 which it is desired to obtain.

Experience has shown that shredding of the ends of the bristles by grinding takes place substantially only on bristles of relatively large diameter, greater than 0.1 mm.

The brush 1 is thus at least partially equipped with bristles of relatively large diameter, in particular between 0.1 mm and 0.3 mm.

The bristles of smaller diameter that is to say of a diameter less than 0.1 mm and in particular of the order of 0.06 mm, undergo practically no modification during the grinding operation.

The brush may consist of a mixture of thick bristles of a diameter greater than 0.1 mm and generally less than 0.3 mm, and of small bristles of a diameter less than 0.1 mm and in particular of the order of 0.06 mm.

As shown in FIGS. 3 to 6, it is possible to use shaped grinding wheels 8*a*, 8*b* capable of giving the brush the desired form while shredding the ends of the bristles takes place simultaneously. The shaped grinding wheels 8*a*, 8*b* thus make it possible to avoid using clippers.

The grinding wheel 8*a* (FIG. 3) is a body of revolution whose generatrix is formed by a concave curved line whose concavity faces outwards The grinding operation is performed under conditions similar to those described with reference to FIGS. 1 and 2 (parallel axes of rotation, rotation in opposite directions After grinding, the longitudinal profile of the brush 1*a* reproduces the longitudinal profile which is opposite to that of the grinding wheel 8*a*, that is to say that the generatrix of the brush 1*a* is formed by a curved arc which is convex toward the outside, the large base of the brush corresponding to the small base of the grinding wheel 8*a* and vice versa.

Figure 5:
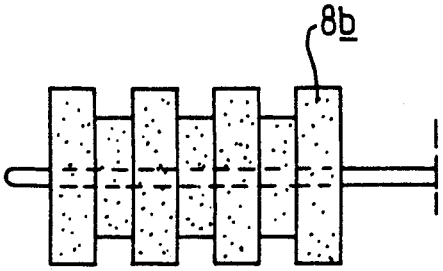
FIG. 5 is a view similar to FIG. 3 of another shaped grinding wheel whose longitudinal section is bounded by a crenellated line.
Figure 4:
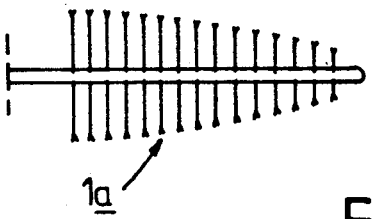
FIG. 4 is a diagrammatic view, in elevation, of a brush which has undergone grinding with the grinding wheel of FIG. 3.
Figure 6:
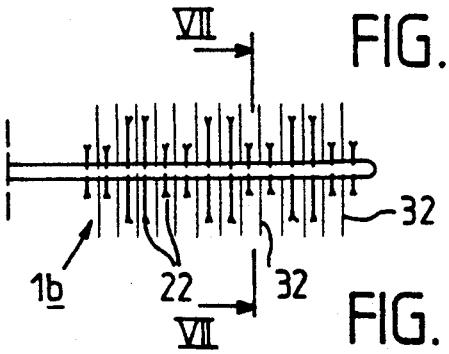
FIG. 6 is a diagrammatic view, in elevation, of a brush which has undergone grinding with the grinding wheel of FIG. 5.

FIG. 5 shows another type of shaped grinding wheel 8*b* which consists of a body of revolution whose generatrix is formed by a line with rectangular crenellations. The action of such a grinding wheel 8*b* on the relatively large diameter bristles of a brush 1*b* shown in FIG. 6, reproduces on the brush the longitudinal profile which is opposite to that of the grinding wheel; the brush 1*b* will have bristles of radial dimensions which are larger at the locations of the recesses of the grinding wheel 8*b* and bristles of radial dimensions which are smaller at the locations of the projecting parts of the grinding wheel 8*b*.

Figure 7:
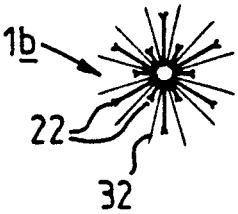
FIG. 7 is a diagrammatic section of the brush of FIG. 6 along the line VII-VII of FIG. 6.

If the brush 1*b* comprises a mixture of bristles 22 of large diameter on which the grinding action has a wearing and shredding effect, and of bristles 32 of smaller diameter on which the grinding has practically no effect, then at the end of grinding, as represented in FIG. 7, a brush is obtained which is formed by a layer of small diameter bristles 32, whose radial dimension is greater than that of the bristles of large diameter which have undergone the grinding action. In this manner, the large diameter bristles and their shredded ends are located within the surface surrounding the ends of the small diameter bristles.

The effect of grinding on the bristles depends on the transverse section of these bristles.

Each cross-sectional form of bristle will create its own form of hooks.

Figure 8:
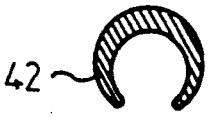
FIG. 8 is a transverse section of a bristle having a horseshoe cross-section.
Figure 9:
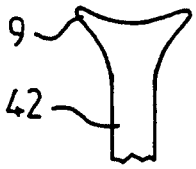
FIG. 9 is a diagrammatic representation of the end of the bristle of FIG. 8 after grinding.

When it is ground, a bristle 42 with a horseshoe section (see FIG. 8) creates at its end a fork form 9 (FIG. 9).

After grinding, a hollow cylindrical bristle (not shown) would give at its end a form similar to that of FIG. 9.

Figure 10:
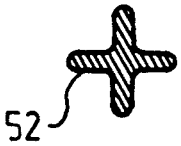
FIG. 10 is a transverse section of a bristle with a cruciform cross-section.
Figure 11:
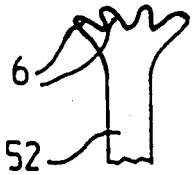
FIG. 11 is a diagrammatic representation of the end of the bristle of FIG. 10 after grinding.

After grinding, a bristle 52 with a cruciform transverse cross-section (FIG. 10) creates at its end four hooks 6 (FIG. 11) having the appearance of a "square nail head".

Figure 12:
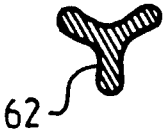
FIG. 12 is a transverse section of a bristle with a threelobed cross-section.
Figure 13:
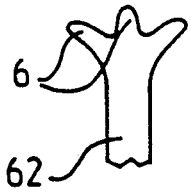
FIG. 13 is a diagrammatic representation of the end of the bristle of FIG. 12 after grinding.

A bristle 62 (FIG. 12) with a three-lobed cross-section creates at its end three hooks 6 (see FIG. 13) in a "fleur de lys" form.

It is possible to obtain, on a brush with mixed bristles having different sections, a very specific surface condition which may be varied within wide limits.

It is possible to produce brushes with mixed bristles having hardnesses which are different when dry but which are the same when the bristles are moistened by the product. For example, it is possible to produce a brush with a mixture of cylindrical bristles in nylon 6, having a diameter of 0.24 mm; of bristles in nylon 11 with a horseshoe section having a diameter of 0.17 mm; and of cruciform bristles in nylon 6.6 having a diameter of 0.17 mm.

The ground brushes according to the invention offer greater softness and improved contact.

The invention also makes it possible to increase the smoothing surface of the portion of large diameter bristles In the case of bristles with a three-lobed section having a diameter of 0.24 mm, make-up is lighter with bristles whose ends are ground than in the case where the ends have not undergone grinding.

Figure 14:
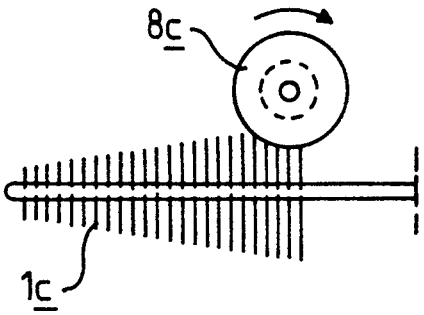
FIG. 14 is a diagrammatic representation of another type of grinding of the brush.
Figure 15:
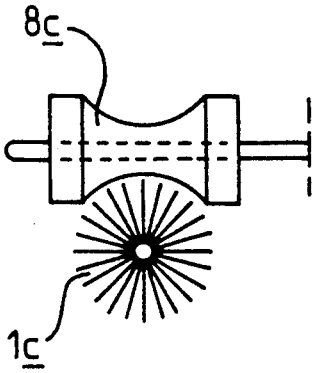
FIG. 15, finally, is a view from the right relative to FIG. 14.

Make-up may thus be modified in a virtually limitless manner without having to change the diameter of the wiper of the mascara applicator.

possible to grind into shape a brush 1*c* (see FIGS. 14 and 15) which has already been cut with clippers without rotating the brush about its axis. The grinding wheel 8*c* rotates about an axis which is substantially orthogonal to the axis of the brush 1*c*, and the axis of the grinding wheel 8*c* is displaced in translation in the direction of the axis of the brush 1*c*. The transverse section of the grinding wheel 8*c* may have a substantially diabolo form, as may be seen in FIG. 15.

Although the brush 1*c* is not driven by a continuous rotating movement about its axis, in order to perform grinding over the entire periphery of this brush, the brush may at regular intervals be subjected to a rotary movement of a predetermined angular pitch about its axis.

The bristles which may be used for producing brushes according to the invention may be of animal origin or synthetic origin, for example made from nylon or polyester. The bristles of natural origin may be used in a mixture with synthetic fibres.

A brush according to the invention, at least some of whose bristles have a shredded end, makes it possible to touch the eyelashes better and to curl them better.

Grinding makes it possible to create a sort of down while retaining on the bristles of large diameter, possibly equipped with capillary grooves, the space forming a reservoir for the product to be applied.

It should be noted that in other possible embodiments, the brushes are obtained by means of a method in which, in a first stage, the core of the said brushes and their bristles are produced integrally by injection into a shaping mould, and, in a second stage, the ends of the said bristles are shredded.

Moreover, it is possible to produce the shredded ends of the bristles of the brushes according to the invention other than by grinding and, for example, by carding or any other abrasion technique.

I claim:

1. A method for manufacturing a mascara product supplying brush of the type having a multiplicity of bristles mounted on a core having a longitudinal axis and oriented transversely relative to said axis of the core, and the steps comprising utilizing bristles for the brush having a diameter of from 0.1 mm to 0.3 mm and grinding the ends of the bristles of the brush with a rotary grinding wheel in order to shred the ends of the bristles farthest from the core and to form small hooks at said ends.

2. A method according to claim 1, wherein the core is formed by two branches of a metal wire twisted into a helix.

3. A method according to claim 1, wherein the core of said brush and its bristles are produced integrally by injection into a shaping mould, and the ends of the bristles of the resulting brush undergo said rotary grinding in order to shred the ends of the bristles farthest from the core and to form the small hooks at said ends.

4. A method according to claim 1, wherein the grinding wheel is rotated about an axis which is substantially orthogonal to that of the core.

5. A method according to claim 4, wherein the brush remains stationary during grinding.

6. A method according to claim 1, wherein the rotary grinding wheel has an axis of rotation and said brush is rotated in one direction about the axis of its core while said grinding wheel is rotated in the opposite direction about an axis of rotation substantially parallel to that of said brush so as to obtain a meshing effect between said grinding wheel and the bristles of the brush and wherein the speeds of rotation of the brush and of said grinding wheel are set at different values in order to obtain gradual grinding without heating up.

7. A method according to claim 1 including the step of using a grinding wheel having a selected contour to impart to the brush a contour complimentary to that of the grinding wheel.

* * * * *